US005102359A

United States Patent [19]

Hinds

[11] Patent Number: 5,102,359

[45] Date of Patent: Apr. 7, 1992

[54] THRUST DIRECTOR AND STAND

[76] Inventor: William R. Hinds, Balsam Lake, Wis. 54810

[21] Appl. No.: 655,495

[22] Filed: Feb. 14, 1991

[51] Int. Cl.[5] ..... B63B 5/06

[52] U.S. Cl. ..... 440/66; 440/6; 248/640

[58] Field of Search ..... 248/640; 440/6, 51, 440/66, 71, 72, 900

[56] References Cited

U.S. PATENT DOCUMENTS

| | | | |
|---|---|---|---|
| 1,181,634 | 5/1916 | Bivery | 440/900 |
| 3,230,698 | 1/1966 | Nettles | 440/6 X |
| 3,768,432 | 10/1973 | Spaulding | 440/66 |
| 3,828,713 | 3/1975 | Duryea | 114/163 |
| 3,872,817 | 8/1974 | Duryea | 114/163 |
| 4,352,666 | 10/1982 | McGowan | 440/53 |
| 4,634,388 | 1/1987 | Covell | 440/6 |
| 4,669,987 | 6/1987 | Schulte | 440/6 |
| 4,715,836 | 12/1987 | Schulte | 440/6 |

*Primary Examiner*—Edwin L. Swinehart

*Attorney, Agent, or Firm*—Jacobson & Johnson

[57] ABSTRACT

A combination steering attachment and stand for electric trolling motors to permit the more efficient use of low thrust electric trolling motors for steering a boat and to also provide a stand to set the trolling motor on when it is removed from the boat. The attachment includes two flanking plates that extend parallel to and alongside the electric motor and the propeller and remain in a fixed parallel relationship to the axis of rotation of the propellor to continually direct all of the motor thrust along the axis extending through the propeller. The flanking propellor plates also protect the propellor from hitting obstructions in the water.

15 Claims, 4 Drawing Sheets

THRUST DIRECTOR AND STAND

FIELD OF THE INVENTION

This invention relates generally to attachments for electric trolling motors, and more specifically, a combination thrust director and stand for an electric trolling motor.

BACKGROUND OF THE INVENTION

The concept of rudders for steering boats is well known in the art. Typically the rudders for steering boats take two main configurations: a propellor flanking configuration where the rudders are pivoted about a stationary axis propellor and a non-propellor flanking position wherein both the propellor and the rudder are pivoted together. Both of these type of rudder systems have an inherent inefficiency in that the thrust generated by the motor during the turning or steering of the boat is inefficiently used. In the propellor flanking configuration thrust is used inefficiently since the axis of thrust direction must be non parallel to the rudders in order for one to turn the boat. In most instances, the outboard motors have sufficient power so that the loss of thrust during turning produces little effect. However, in the use of electric trolling motors which have limited thrust, the inefficiencies of the known rudder systems provide noticeable loss of control in steering a boat.

The present invention is a thrust director that substantially eliminates the power loss due to conventional rudder systems and also provides protection for the motor propeller as well as providing a stand for the motor when the trolling motor is removed from the boat.

DESCRIPTION OF THE PRIOR ART

Bivert U.S. Pat. No. 1,181,634 shows an outboard motor having a large rudder fin located in front and in line with the axis of the motor. The described purpose of the rudder is to keep the boat on a straight course.

Schulte U.S. Pat. No. 4,669,987 shows an outboard trolling motor with a fin extending downward in axial alignment with the axis of rotation of the propeller.

Schulte U.S. Pat. No. 4,715,836 similarly shows an outboard trolling motor with the same lower angled fin.

Covell U.S. Pat. No. 4,634,388 shows an electric trolling motor with the rudder fin located above the trolling motor but in alignment with the axis of rotation of the motor.

McGowan U.S. Pat. No. 4,352,666 shows an outboard motor with dual fins located rearward of the rotating propeller. These fins are called trim tabs and permit the user to compensate for uneven drag of the boat so that the motor runs true.

Duryea U.S. Pat. No. 3,872,817 shows a dual rudder system encompassing a fixed shaft and propeller. By moving the outer plates around the shaft, the user controls the direction of the boat can be steered in. The thrust always remains directed toward the rear of the boat.

Duryea U.S. Pat. No. 3,828,713 shows another embodiment of a boat flanking rudder system. The boat flanking rudder system includes a housing for surrounding the propeller with the rudder system including a hydrofoil to provide lift to the boat.

BRIEF SUMMARY OF THE INVENTION

Briefly the present invention comprises an attachment for electric trolling motors to permit the more efficient use of low thrust electric trolling motors for steering a boat and to also provide a stand to set the trolling motor on when it is removed from the boat. The invention includes two flanking plates that extend parallel to and alongside the electric motor and the propeller to continually direct all of the motor thrust along an axis extending through the propeller. The flanking propellor plates also protect the propellor from hitting obstructions in the water.

DESCRIPTION OF THE PREFERRED EMBODIMENT

Figure 1:
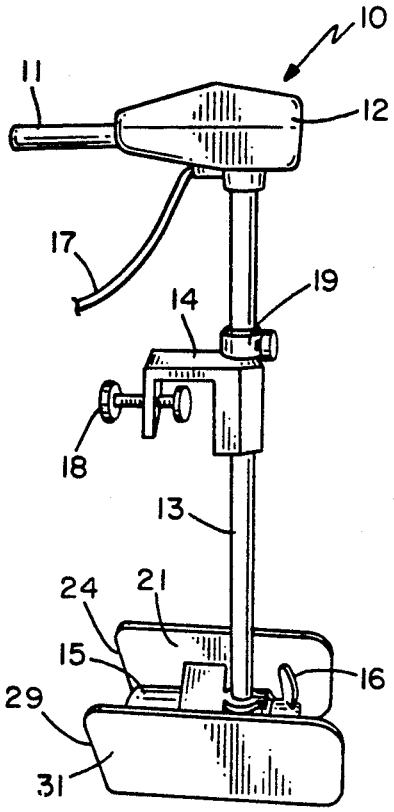
FIG. 1 shows an electric trolling motor with my thrust deflectors and stand flanking the lower housing of the outboard motor.

Referring to FIG. 1, reference numeral 10 generally designates an electric trolling motor having my thrust deflector and stand attached thereto. The electric trolling motor comprises a steering arm 11 and a top housing 12 connected to an electric motor housing 15 by a vertical cylindrical shaft 13. A mounting bracket 14 permits the user to mount the electric trolling motor on a boat and to rotate the motor about an axis extending through vertical cylindrical shaft 13. The screw clamp 18 holds the motor to the boat and a clamp 19 permits the user to adjust the vertical distance the motor and propellor extend into the water. Power to the motor is supplied by power cables 17 which connect to a 12 volt storage battery (not shown). Located rearward of housing 15 is a propeller 16 for generating the thrust for forcing the boat through the water. My invention is shown located in a flanking relationship to the motor housing and in fixed parallel relationship to each other and an axis of rotation of propellor 16 are a first thrust plate stand member 21 and a second thrust plate stand member 31.

Figure 2:
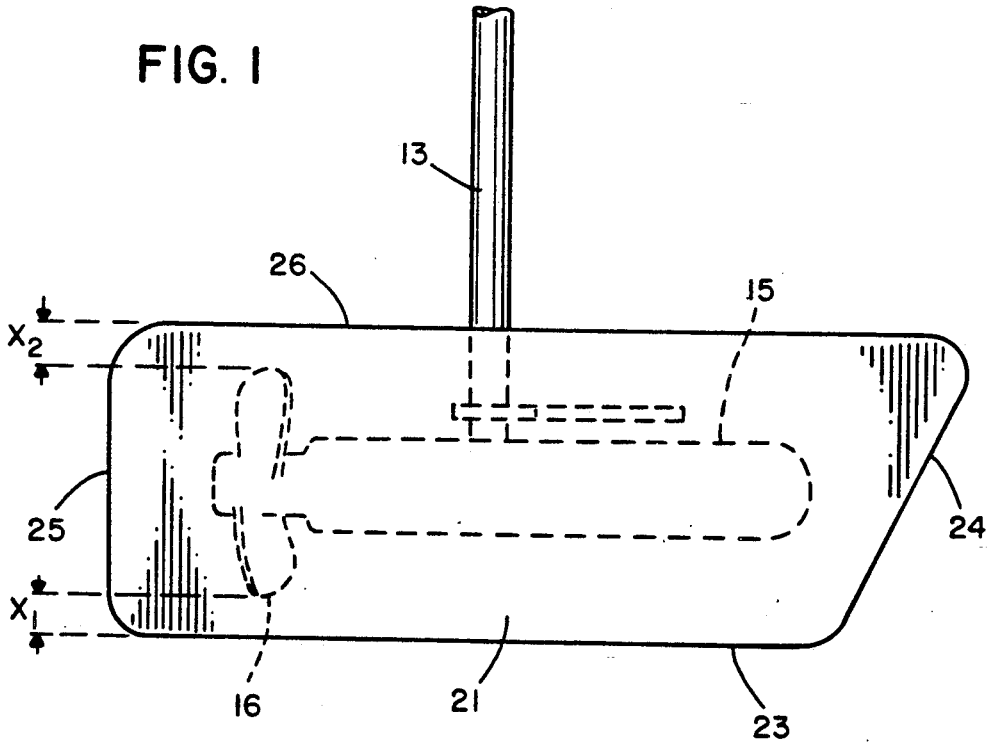
FIG. 2 shows a side view of the lower housing of the electric motor with the motor located in phantom.

FIG. 2 shows a partial side view illustrating the relationship of thrust plate stand member 21 to motor housing 15. Note when viewed from the side that the thrust plate stand member 21 extends forward, rearward, above and below motor housing 15. The distance below propellor 16 is designated as $x_1$ and the distance above propellor 16 is designated by $x_2$. Thrust plate stand member 21 has a lower straight edge 23 that is perpendicular to vertical shaft 13. Thrust plate stand member 21 includes a tapered front edge 24, a straight top edge 26 and a straight rear edge 25. The location of the thrust plate stand member 21 alongside the motor housing partially isolates the water outside the thrust plate stand member 21 from the water between the thrust plate stand member 21 and one side of the motor housing 15. Similarly, a thrust plate stand member 31 located on the opposite side is identical to thrust plate 21 and partially isolates the water outside the thrust plate stand member 31 from the water between the thrust plate stand member 31 and one side of the motor housing 15.

Thrust plate stand member 31 includes a tapered front edge 29, a straight top edge 34 and a straight rear edge 38. The combination of the two thrust plate stand members 21 and 31 define a box like interior region there between that produces a channel effect to maintain substantially all of the water being forced through propeller 16 to move parallel to axis 20 (FIG. 4) of motor 10 as it flows through the region between the thrust plate stand member 21 and 31. Consequently, the thrust generated by the propellor 16 is maintained along axis 20.

Figure 4:
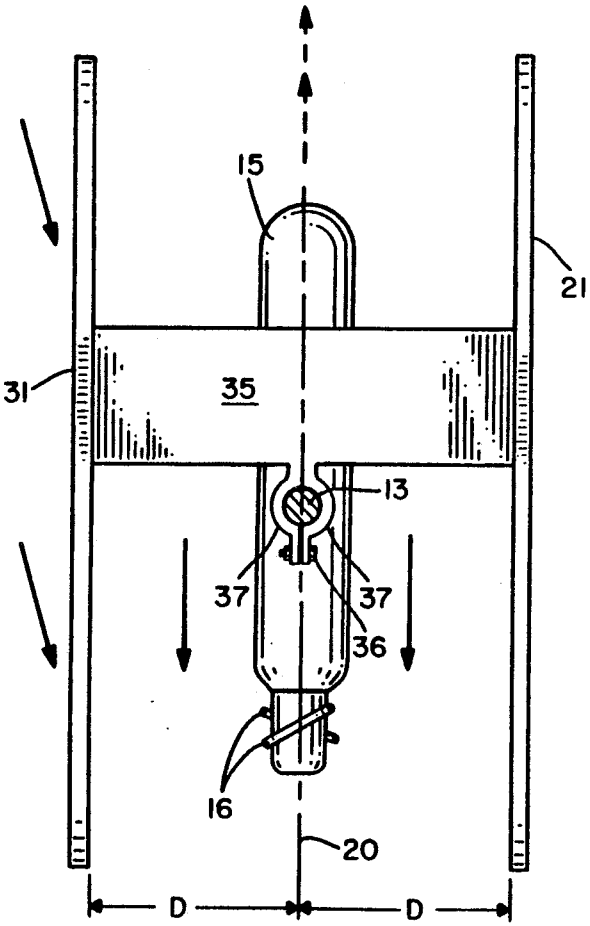
FIG. 4 shows a top view of the housing in my thruster stand.

FIG. 4 shows that the thrust plate stand members 21 and 31 also isolate the box like interior region between thrust plate stand member 21 and thrust plate stand member 31 from the effects of side currents. The axis 20 is located a distance d from each side. Typically, d is about 6 inches. Note the arrows outside of thrust plate stand member 31 that indicate the direction of water impinging on thrust plate stand member 31. Also note the general direction of the water (indicated by arrows) in the box like region between thrust plate stand member 21 and thrust plate stand member 31. That is the direction of the water flowing thereto is substantially parallel to axis 20 and remains substantially parallel to axis 20 since the flanking thrust plate stand member 21 and 31 are fixed to shaft 13 and are maintained parallel to axis 20. Consequently, all the thrust is directed along axis 20.

Figure 3:
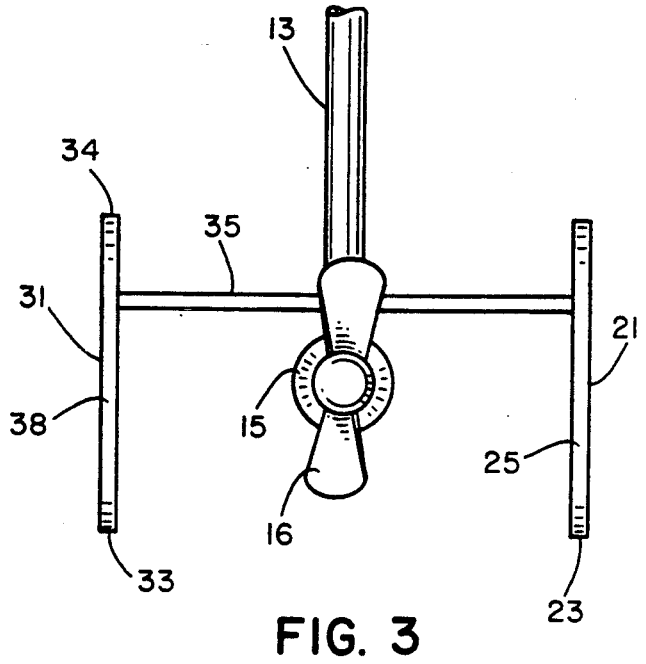
FIG. 3 shows a rear view of the housing and my combination thruster stand.

FIG. 3 and FIG. 4 shows thrust plate stand member 21 and thrust plate stand member 31 spaced equidistant d from the axis of rotation of propeller 16. A cross member 35 connects thrust plate stand member 21 and thrust plate stand member 31 to each other and to cylindrical shaft 13 through a two part pressure clamp 37 held in place by a bolt 36.

FIG. 4 shows a top view of the rudder steering mechanism. The thrust plate stand member 21 and thrust plate stand member 31 are held in a spaced parallel relationship on either side of motor housing 15. Cross member 35 is shown with a split collar 37 connected thereto with a bolt 36 extending through it to permit one to frictionally attach the steering cross member 35 to cylindrical shaft 13. The dashed arrows along the axis of rotation 20 indicated the general forward direction the motor is being forced to move through the water. The arrows outside the thrust plate stand member 21 indicate the direction of the oncoming water as a user turns the motor housing 15 to propel the boat in a different direction through the water. Note that in the vicinity proximate propeller 16 the water is being directed parallel to the axis of rotation 20 of the propeller. Consequently the thrust of the electric motor is not diminished by cross flow of water occurring outside the thrust plate stand member 21 and 31. Maintaining of the thrust plate stand member 21 and thrust plate stand member 31 in parallel relationship surrounding motor housing 15 and propellor 16 through turning of motor 10 results in the low thrust of the electric motor being able to be fully utilized to power the boat more quickly through a turn then if the motor housing and propellor 16 were unprotected.

Figure 5:
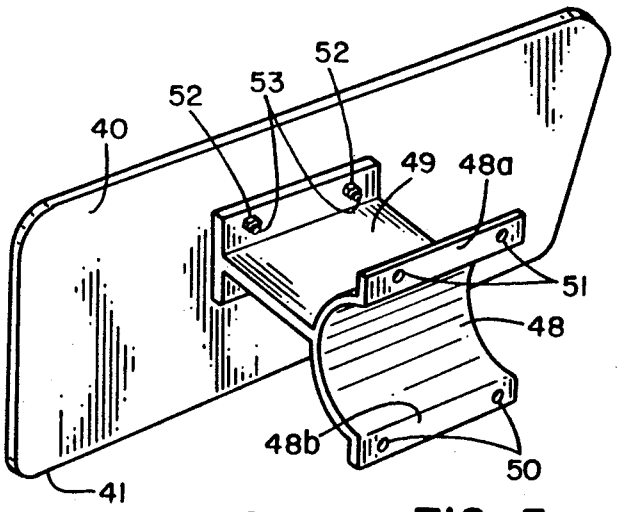
FIG. 5 shows an alternate embodiment for attaching to an outboard motor.
Figure 6:
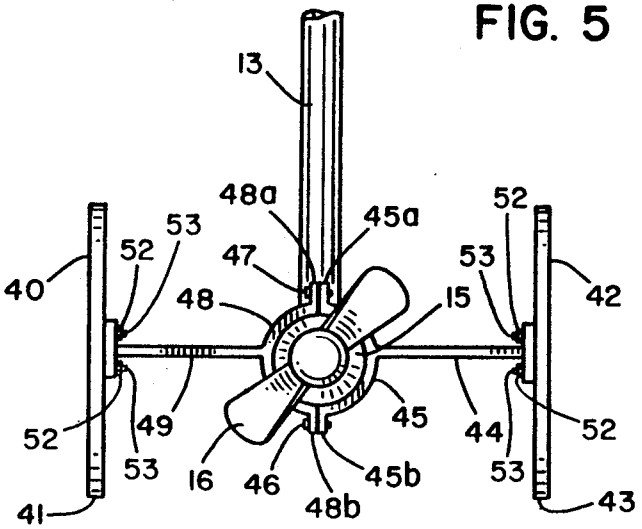
FIG. 6 shows a rear view of the alternate embodiment mounted on the lower housing of electric trolling motor.

FIG. 5 and FIG. 6 shows an alternate embodiment with thrust plate stand members for attachment directly to motor housing 15 of an electric motor. Attached to one side of motor housing 15 is a thrust plate stand member 40 having a lower edge 41 and a cross member 49. Attached to one end of cross member 49 is a flange that is fastened to thrust plate stand member 40 by bolts 53 and nuts 52. Attached to the other end of cross member 49 is a C-shaped housing having a top flange 48 and a bottom flange 48*b*. Similarly, located on the opposite side of housing 15 is a thrust plate stand member 42 having a lower edge 43 and a cross-member 44. Attached to cross member 44 is a C-shaped housing 45 having a top flange 45*a* and a bottom flange 45*b*. A bolt 47 extends through flanges 45*a* and 48*a* to hold the top flanges together and a bolt 46 extends through flanges 45*b* and 48*b* to hold the bottom flanges together. The combination of the C-shaped housings and the bolts hold the two C-shaped housings in frictional contact with the motor housing to permit the thrust end members 40 and 42 to be held and maintained in a spaced parallel relationship to motor housing 15 even when the motor is turned about vertical axis 13. Thus a feature of my invention is that the thrust plate stand members can be mounted directly to the motor housing to provide flanking thrust plate stand members that remain parallel with the axis of the motor.

In my thrust director system propellor has a tip that rotates, the tip of the propellor forms a circle of tip rotation with the circle of tip rotation located above a plane extending through the lower edges of the thrust plate stand members to coact to form a bottom guard to thereby protect the propeller from directly engaging a lake bottom.

A further feature of my invention is that the lower straight edges of the thrust plate stand members provide a stand for the electric motor when the motor is not in use. FIG. 1 illustrates how the thrust plate stand member hold the electric trolling motor in an upright position. That is because the thrust plate stand members are spaced sufficiency far in all directions from cylindrical shaft 13 the center of gravity of the electric motor lies within an imaginary column extending upward from the thrust plate stand members. Thus when not in use my thrust plate stand members permit a user to store the electric tolling motor in an upright position.

A further feature of the invention is that the flanking thrust plate stand members protect the propellor of my invention both when the electric motor is in or out of the water. That is when the motor 10 is in the water the thrust plate stand member act as a protective shroud around the propellor to protect the propellor from underwater obstructions. Likewise the thrust plate stand member prevent a person from accidentally stepping on the propellor 16 when the electric motor is in storage.

Figure 7:
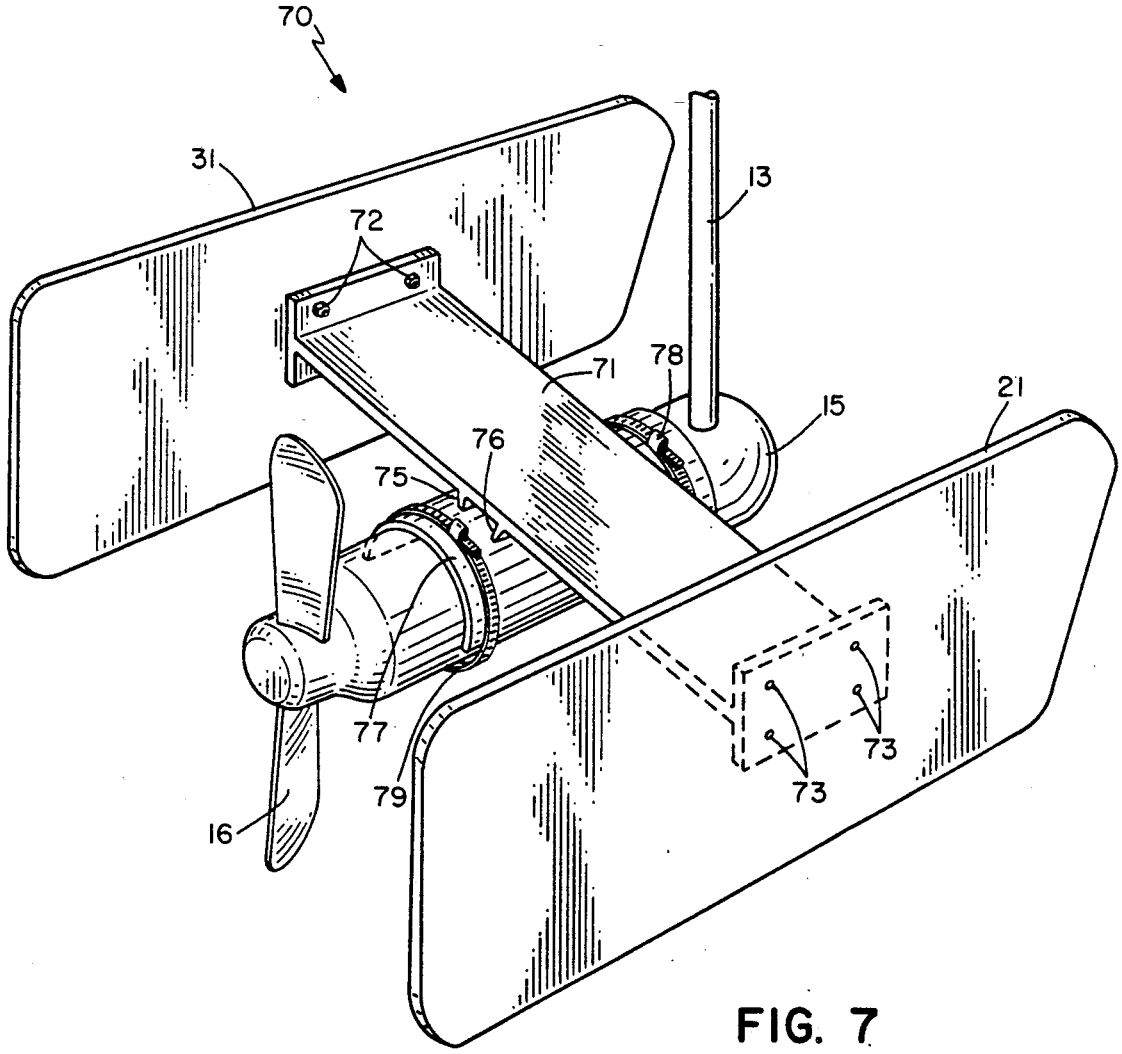
FIG. 7 shows a perspective view of an alternate embodiment of my thrust director and stand.
Figure 8:
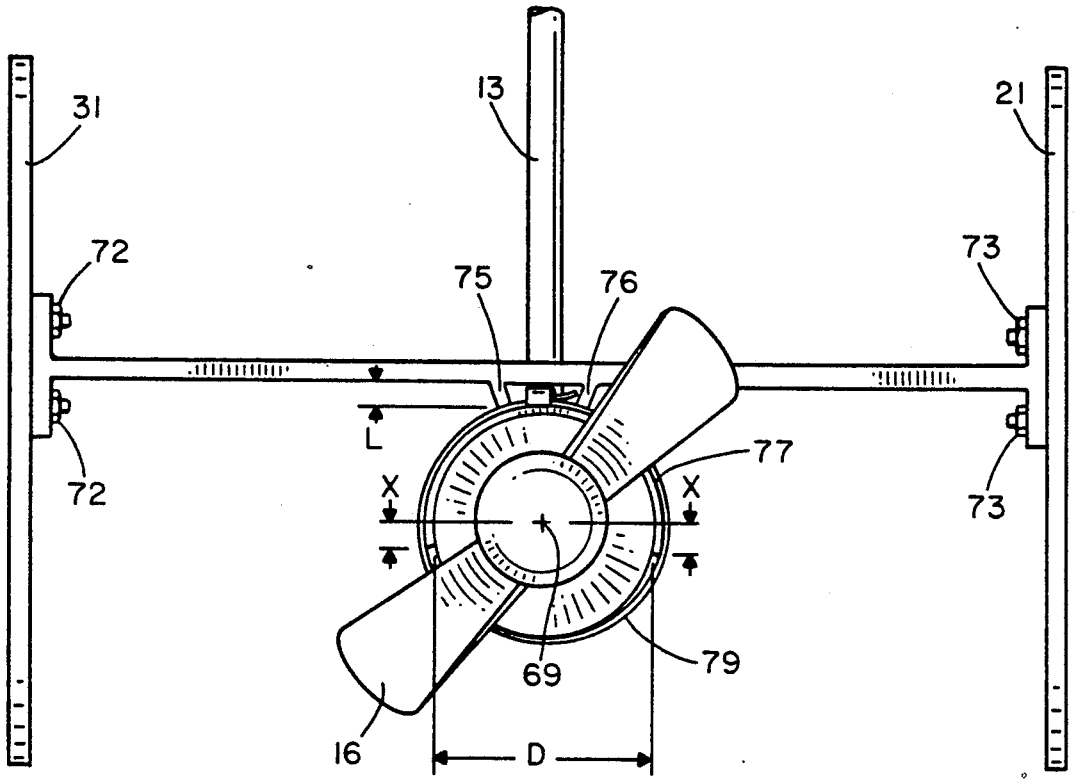
FIG. 8 shows an end view of the embodiment of my thrust director and stand of FIG. 7.

Referring to FIG. 7, reference numeral 70 generally identifies an alternate embodiment of my thrust director stand. Thrust plate stand members 21 and 31 are identical to that shown in the embodiments of FIG. 4. Electric trolling motor 15 is identical to that shown in FIG. 4 except that the cylindrical shaft 13 is located at the rear of motor housing 15 rather than midway. Extending between thrust plate stand member 31 and thrust plate stand member 21 is a cross member 71. One end of cross member 71 is held in perpendicular position against thrust plate stand member 31 by bolts 72 and the opposite end is held in perpendicular position against thrust plate stand member 21 by bolts 73. Extending downward from the underside of cross member 71 is a first spacer member 75 and a second spacer member 76 which connect to a semi-cylindrical arcuate-shaped member 77 that extends along the top portion of motor housing 15. Member 77 is generally in a cylindrical shape and is made of somewhat flexible and resilient material to permit member 77 to be spread apart and slipped over motor housing 15. That is, member 77 forms a general mating type fit over housing 15. In order to hold member 77 in position, I provide pressure clamps 78 and 79 which can be tightened to tightly hold member 77 on motor housing 15. The advantage of the embodiment of FIGS. 7 and 8 is that the thrust director and stand 70 allows one to fasten the thrust director and stand directly over a portion of the motor housing with the aid of only two pressure clamps. In addition, the use of a somewhat flexible resilient metal material for member 77 allows the invention to be attached to motors having different diameters. The spacing of cross member 71 above the motor lessens the chance of engagement with objects in the water.

FIG. 8 shows a rear view of my invention illustrating the partial wrap-around feature of member 77. Note the cross member is spaced a distance L above the top member 77. Member 77 extends past the center point 69 of motor housing 15 by a distance denoted by x. Typically, x may be a half inch to an inch. The diameter of the motor is designated by D.

Figure 9:
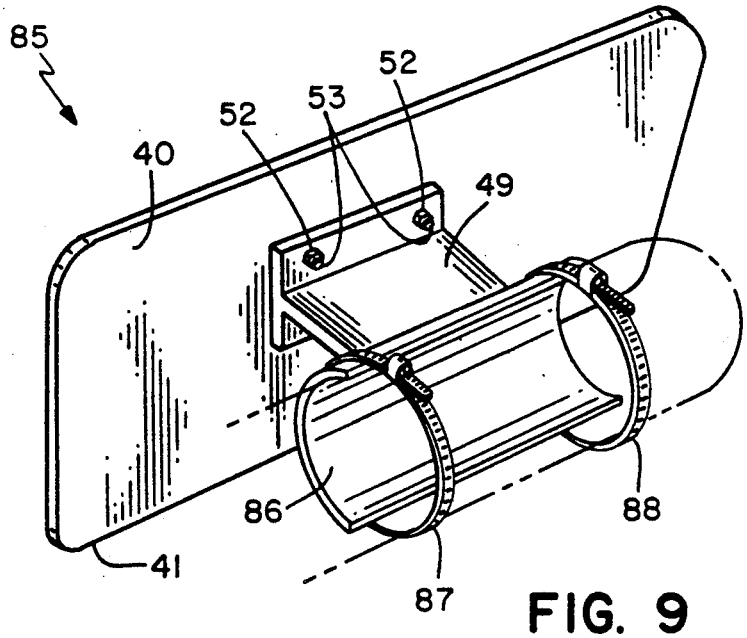
FIG. 9 shows a perspective view of a further alternate embodiment of my thrust director and stand.

Referring to FIG. 9 reference numeral 85 identifies an alternate thrust-plate stand member. Thrust-plate stand member 40 is identical to that shown in FIG. 5 except the attachment for motor housing 15 does not include flanges. Instead an arcuate curved section 86 which abuts with member 49 extends outward to engage a portion of an outboard motor. That is, member 86 is generally the same radius as that of motor housing 15 so that it can be fitted partially around motor housing 15. The embodiment of FIG. 9 is similar to that of FIG. 7 except pressure clamps are used with the embodiment of FIG. 9 and flanges are used with the embodiment of FIG. 9. In the embodiment of FIG. 9 as in FIG. 7 one thrust plate stand member is placed on each side of the motor housing. In the embodiment of FIG. 9 both thrust plate stand members are held in place on the motor housing by pressure clamps 87 and 88 thus my invention permits one to use one size of thrust plate stand members on different diameter motor housings since only a portion of the curved section is needed to engage the motor housing.

I claim:

1. A thrust director system comprising:

an outboard trolling motor for attaching to a boat, said outboard trolling motor having a housing with a propeller for propelling said outboard trolling motor through a body of water, said propellor having an axis of rotation;

a first thrust plate stand member, said first thrust plate stand member having a general planar shape, said first thrust plate stand member larger than said housing and said propellor, said first thrust plate stand member located in a first fixed flanking position alongside said housing and said propellor, said first thrust plate stand member having a leading edge and a lower edge;

a second thrust plate stand member, said second thrust plate stand member having a general planar shape, said second thrust plate stand member larger than said housing and said propellor, said second thrust plate stand member located in a second fixed flanking position alongside said housing and said propellor, said second thrust plate stand member having a leading edge and a lower edge, said first thrust plate stand member and said second thrust plate stand member located in a fixed spaced flanking position parallel to said axis of rotation of said propellor, said first thrust plate stand member and said second thrust plate stand member including an attachment member for holding said first thrust plate stand member and said second thrust plate stand member to a shaft of the outboard trolling motor, said leading edge of said first thrust plate stand member and said leading edge of said second thrust plate stand member defining an inlet for water to flow between said first thrust plate stand member and said second thrust plate stand member, said inlet free of cross members that would prevent water entering said inlet from flowing in a direction parallel to the axis of rotation of said propellor, said first thrust plate stand member and said second thrust plate stand member located sufficiently close to said housing and said propellor so that said propellor forces water to flow between said housing and said first thrust plate stand member and said second thrust plate stand member to thereby continually direct the thrust generated by said propellor along said axis of rotation, said first thrust plate stand member and said second thrust plate stand member extending beyond said housing and said propellor so that when said said first thrust plate stand member and said second thrust plate stand member, said housing and said propellor are turned the thrust generated from said propellor remains directed along said axis of rotation, said first thrust plate stand member and said second thrust plate stand member located sufficiently far from each other so that said lower edge on said first thrust plate stand member and said lower edge on said second director coact to form a stand for holding said outboard motor in an upright position when said outboard is in storage.

2. The thrust director system of claim 1 including a member for mounting said first thrust plate stand member and said second thrust plate stand member around said housing so that lateral pivoting of said housing produces lateral pivoting of said first thrust plate stand member and said second thrust plate stand member.

3. The thrust director system of claim 2 including a clamp for detachable mounting said first thrust plate stand member and said second thrust plate stand member to said housing.

4. The thrust director system of claim 3 wherein said first thrust plate stand member and said second thrust plate stand member are substantially identical in size and shape to each other so that each of said first thrust plate stand member and said second thrust plate stand member create conditions of similar water flow between itself and said housing.

5. The thrust director system of claim 4 wherein said housing includes an electric trolling motor for rotating said propellor.

6. The thrust director system of claim 5 wherein said propellor has a tip that rotates, said tip of said propellor forms a circle of tip rotation with said circle of rotation located above a plane extending through said lower edge of said first thrust plate stand member and said lower edge of said second thrust plate stand member so that said first thrust plate stand member and said second thrust plate stand member coact to form a bottom guard to thereby protect said propeller from directly engaging a lake bottom.

7. The thrust director system of claim 6 wherein said first thrust plate stand member and said second thrust plate stand member are located in parallel relationship to each other and are each spaced about six inches from said axis of said propellor.

8. The thrust director system of claim 7 wherein said first thrust plate stand member has a trailing edge and a top edge and said second thrust plate stand member has a trailing edge and a top edge so that a first plane extending through said top edge of said first thrust plate stand member and said top edge of said second thrust plate stand member is located outside said circle of tip rotation and a second plane extending through said trailing edge of said first thrust plate stand member and said trailing edge of said second thrust plate stand member is also located outside said circle of tip rotation.

9. An attachment for a slow moving outboard trolling motor to conserve the thrust of the motor as the trolling motor is turned from side to side comprising:

a first motor and propellor flanking plate and a second motor and propellor flanking plate, said first motor and propellor flanking plate and said second motor and propellor flanking plate located in a spaced parallel relationship to each other, said first motor and propellor flanking plate and said second motor and propellor flanking plate including means for fixedly attaching said first motor and propellor flanking plate and said second motor and propellor flanking plate to the housing of an outboard trolling motor so that said first motor and propellor flanking plate and said second motor and propellor flanking plate form a flanking water shroud around a propellor and housing of an outboard trolling motor so that when said said first motor and propellor flanking plate and said second motor and propellor flanking plate are fixedly connected to the housing of the outboard trolling motor so that the outboard trolling motor directs water between said first motor and propellor flanking plate and said second motor and propellor flanking plate to thereby enable the thrust of an outboard trolling motor to be continually directed parallel and midway to a channel formed by a first plane extending through said first motor and propellor flanking plate and a second plane extending through said second motor and propellor flanking plate, said attachment including a first C-shaped housing attached to said first motor and propeller flanking plate and a second C-shaped housing attached to said second motor and propeller flanking plate, said first C-shaped housing and second C-shaped housing having substantially the same curvature as the motor housing of an electric motor so that said first motor and propeller flanking plate and said second motor and propeller flanking plate can be attached to said motor housing by use of pressure clamps.

10. The attachment of claim 9 wherein said means for fixedly attaching said first motor and propellor flanking plate and said second motor and propellor flanking plate to the housing includes pressure clamps to hold said said first motor and propellor flanking plate and said second motor and propellor flanking plate to the housing of the outboard trolling motor.

11. The attachment of claim 9 including an arcuate motor mounting member, said arcuate motor mounting member having a semi-cylindrical shape to fit around the housing of an outboard trolling motor.

12. The attachment of claim 11 wherein said arcuate motor mounting member comprises a flexible and resilient member to permit a user to place said arcuate motor mounting member around the housing of an outboard trolling motor.

13. The attachment of claim 12 wherein said arcuate motor mounting member has a semi-circular cross sectional shape.

14. The attachment of claim 9 for said means for fixedly attaching said first motor and propellor flanking plate and said second motor and propellor flanking plate to the housing comprises an arcuate section for mating around a portion of the housing of an outboard trolling motor.

15. The attachment of claim 9 wherein a cross member connects said first motor and propeller flanking plate and said second motor and propeller flanking plate with said cross member spaced from and above the housing of an outboard trolling motor.

* * * * *